US010226922B2

(12) United States Patent
Kusunoki et al.

(10) Patent No.: US 10,226,922 B2
(45) Date of Patent: Mar. 12, 2019

(54) INK JET HEAD HAVING PROLONGED LIFETIME

(71) Applicant: TOSHIBA TEC KABUSHIKI KAISHA, Tokyo (JP)

(72) Inventors: Ryutaro Kusunoki, Mishima Shizuoka (JP); Shuhei Yokoyama, Mishima Shizuoka (JP); Meng Fei Wong, Mishima Shizuoka (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/641,915

(22) Filed: Jul. 5, 2017

(65) Prior Publication Data

US 2018/0037023 A1 Feb. 8, 2018

(30) Foreign Application Priority Data

Aug. 5, 2016 (JP) ..... 2016-154887

(51) Int. Cl.
*B41J 2/045* (2006.01)
*B41J 2/14* (2006.01)

(52) U.S. Cl.
CPC ..... *B41J 2/04541* (2013.01); *B41J 2/04573* (2013.01); *B41J 2/04581* (2013.01); (Continued)

(58) Field of Classification Search
CPC ..... B41J 2/04541; B41J 2/04581; B41J 2/14201; B41J 2/14233; B41J 2/14274; B41J 2/1433; H01L 41/0973
See application file for complete search history.

(56) References Cited

U.S. PATENT DOCUMENTS 5,828,394 A * 10/1998 Khuri-Yakub ..... B05B 17/0607 347/72
8,801,147 B2 8/2014 Kusunaki et al.
(Continued)

FOREIGN PATENT DOCUMENTS

JP 2013-075511 4/2013

OTHER PUBLICATIONS

Extended European Search Report dated Jan. 3, 2018, filed in counterpart European Patent Application No. 17133071.4 (9 pages).

*Primary Examiner* — Juanita D Jackson
(74) *Attorney, Agent, or Firm* — Patterson & Sheridan, LLP

(57) ABSTRACT

An ink jet head includes a substrate having a pressure chamber formed therein, the pressure chamber being in communication with a nozzle through which ink is to be discharged, a first plate that is deformable to change a volume of the pressure chamber, and a second plate between the first plate and the pressure chamber, that stretches in response to an electric signal applied thereto. The second plate contracts in an in-plane direction to cause the first plate to deform and thereby the volume of the pressure chamber to be enlarged, when the electric signal is applied, and the second plate returns to an original shape thereof to cause the first plate to return to an original shape thereof and thereby the volume of the pressure chamber to return to an original volume thereof, when the electric signal is no longer applied.

22 Claims, 9 Drawing Sheets

(52) U.S. Cl.
CPC ..... *B41J 2/04588* (2013.01); *B41J 2/04596* (2013.01); *B41J 2/14201* (2013.01); *B41J 2202/15* (2013.01)

(56) References Cited

U.S. PATENT DOCUMENTS

| | | | |
|---|---|---|---|
| 2005/0219328 | A1 | 10/2005 | Kodama |
| 2011/0211022 | A1 | 9/2011 | Yonekubo |
| 2014/0267498 | A1 | 9/2014 | Yokoyama et al. |
| 2016/0355014 | A1 | 12/2016 | Kusunaki et al. |

* cited by examiner

TIMES 0 TO t1

TIMES t1 TO t2

FROM TIME t3

RELATED ART

INK JET HEAD HAVING PROLONGED LIFETIME

CROSS-REFERENCE TO RELATED APPLICATION

This application is based upon and claims the benefit of priority from Japanese Patent Application No. 2016-154887, filed Aug. 5, 2016, the entire contents of which are incorporated herein by reference.

FIELD

Embodiments described herein relate generally to an ink jet head that changes the volume of a pressure chamber filled with an ink and discharges ink droplets from a nozzle which is in communication with the pressure chamber.

BACKGROUND

An ink jet printer that attaches ink droplets onto a medium, such as paper, and forms an image or characters is known. The ink jet printer is provided with an ink jet head that discharges ink droplets in accordance with an image signal.

The ink jet head is provided with a nozzle that discharges ink droplets, an ink pressure chamber that is in communication with the nozzle, and a pressure generation element that generates pressure to discharge an ink in the pressure chamber from the nozzle. A piezoelectric body is used as the pressure generation element. A piezoelectric element that is operated by the piezoelectric body is an electromechanical element that converts a voltage into a force. A voltage applied to this piezoelectric element causes contraction, decompression, or shear deformation. Pressure is generated in the ink in the pressure chamber by means of deformation of the piezoelectric element. Lead zirconate titanate (PZT) is used for representative piezoelectric elements. An inkjet head of the related art includes a substrate, in which an ink pressure chamber is formed, a diaphragm, which is stacked on the substrate, and a piezoelectric element, which is made on the diaphragm. A thin-film piezoelectric body tends to deteriorate when a high voltage is continuously applied for a long period of time. The deterioration of the piezoelectric body shortens the life of the ink jet head.

DETAILED DESCRIPTION

Figure 1:
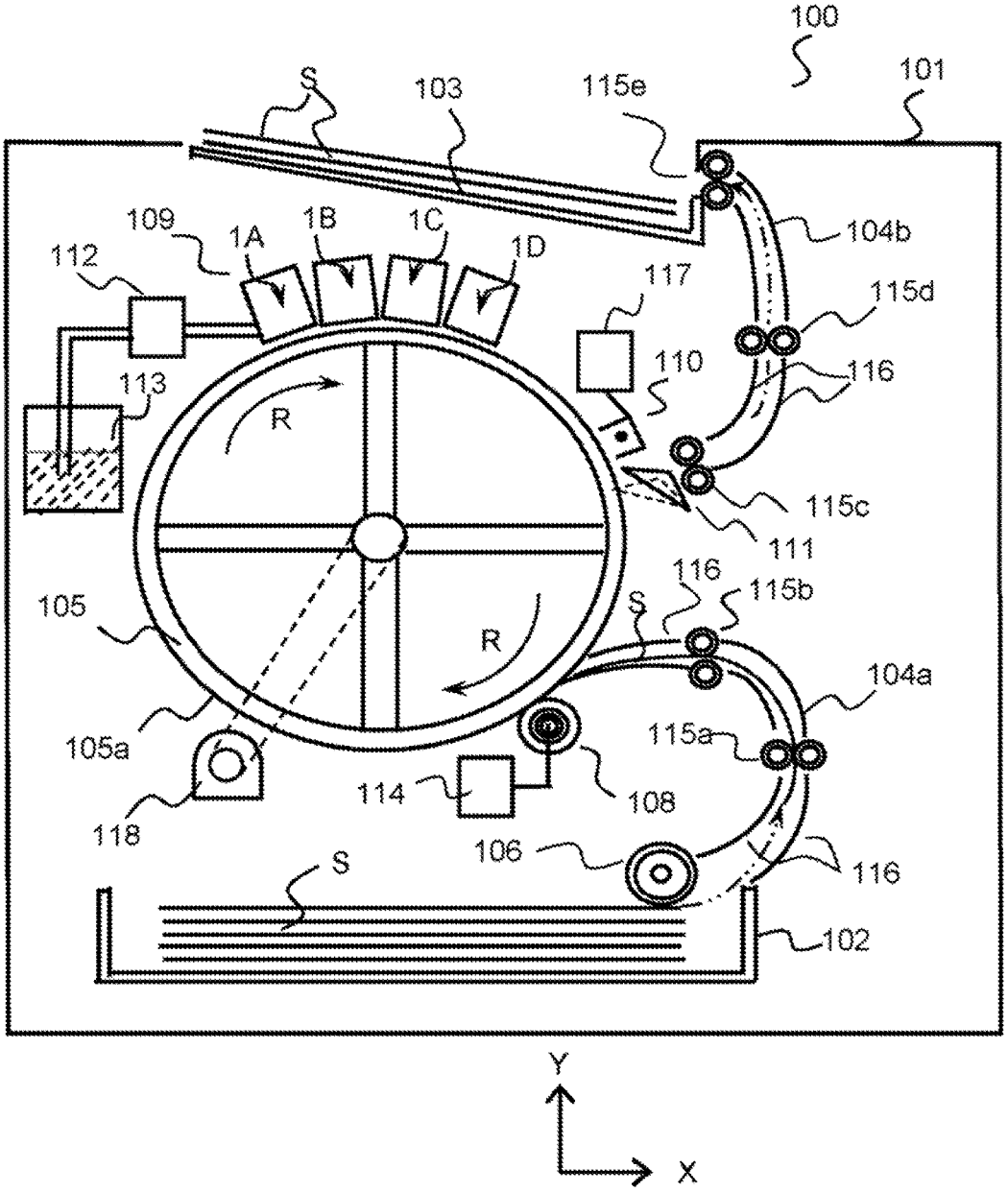
FIG. 1 is a side view schematically illustrating an ink jet printer according to a first embodiment.

A thin-film piezoelectric body tends to deteriorate when a high voltage is applied for a long period of time. When the thin-film piezoelectric body deteriorates, the thin-film piezoelectric body causes dielectric breakdown due to voltage application. There is a possibility that an ink jet head having the thin-film piezoelectric body becomes inoperable. The deterioration of the piezoelectric body shortens the life of the ink jet head.

In general, according to one embodiment, an ink jet head includes a substrate having a pressure chamber formed therein, the pressure chamber being in communication with a nozzle through which ink is to be discharged, a first plate that is deformable to change a volume of the pressure chamber, and a second plate between the first plate and the pressure chamber, that stretches in response to an electric signal applied thereto. The second plate contracts in an in-plane direction to cause the first plate to deform and thereby the volume of the pressure chamber to be enlarged, when the electric signal is applied, and the second plate returns to an original shape thereof to cause the first plate to return to an original shape thereof and thereby the volume of the pressure chamber to return to an original volume thereof, when the electric signal is no longer applied.

Hereinafter, embodiments will be described with reference to the drawings. The same reference numerals in the drawings indicate the same configurations.

First Embodiment

FIG. 1 illustrates a section of an ink jet printer 100 in which ink jet heads (1A, 1B, 1C, and 1D) of the embodiment are mounted. The ink jet heads 1A to 1D (e.g., disposed in print unit 109) discharge cyan, magenta, yellow, and black inks and prints an image onto a printing medium S (e.g., paper) according to an image signal input from outside the ink jet printer 100.

The printing medium S can include plain paper, art paper, coated paper, or an overhead projector (OHP) sheet (e.g., transparent sheet) for overhead projectors.

The ink jet printer 100 has a box type housing 101. The housing 101 includes, from a lower portion to an upper portion in a Y-axis direction, a paper feeding cassette 102, an upstream transport path 104*a*, a holding drum 105, the print unit 109, a downstream transport path 104*b*, and a paper output tray 103. The paper feeding cassette 102 accommodates the paper S, on which printing is to be performed by the ink jet printer 100. The print unit 109 is provided with four ink jet heads, including the ink jet head 1A for cyan, the ink jet head 1B for magenta, the ink jet head 1C for yellow, and the ink jet head 1D for black. The ink jet heads 1A to 1D discharge ink droplets onto the paper S, which is held on the holding drum 105, to print an image.

The paper feeding cassette 102 accommodates the paper S and is provided at the lower portion of the housing 101. A paper feeding roller 106 sends the paper S one by one from the paper feeding cassette 102 to the upstream transport path 104*a*. The upstream transport path 104*a* is configured with a pair of sending rollers 115*a* and 115*b* and a paper guiding plate 116 that regulates a transport direction of the paper S. The paper S is transported by rotation of the pair of sending rollers 115*a* and 115*b*, and is sent by the paper guiding plate 116 to the outer circumferential surface of the holding drum 105 after passing the sending roller 115*b*. A dashed arrow in FIG. 1 indicates a guide path of the paper S.

The holding drum 105 is an aluminum cylinder having an insulating layer 105*a* of which an exterior surface is made with a thin resin. The perimeter of the cylinder is longer than the longitudinal length of the paper S onto which an image is printed, and the length of the cylinder in an axial direction is longer than the length of the paper S in a lateral direction. The holding drum 105 is rotated by a motor 118 in a direction of an arrow R at a constant circumferential speed. The insulating layer 105*a* of the holding drum 105 holds the paper S by static electricity while rotating and transporting the paper S to the print unit 109. A charging roller 108 that electrostatically charges the insulating layer 105*a* is disposed along the insulating layer 105*a*.

The charging roller 108 has a metal rotary shaft and has a conductive rubber layer in the vicinity of the rotary shaft. The charging roller 108 is connected to a high voltage generating circuit 114. The charging roller 108 is driven by a motor such that the exterior surface of the conductive rubber layer is in contact with the insulating layer 105*a* of the holding drum 105 and the charging roller 108 rotates at the same circumferential speed as the circumferential speed of the holding drum 105. The insulating layer 105*a* of the holding drum 105 and the conductive rubber layer of the charging roller 108 form a nip by staying in contact with each other. The paper S is sent to the nip by the sending roller 115*b* and the paper guiding plate 116. A high voltage generated by the high voltage generating circuit 114 is applied to the metal shaft of the charging roller 108 immediately before the paper S is transported to the nip. The insulating layer 105*a* is charged with a high voltage, and the paper S transported to the nip is also charged and is electrostatically adsorbed onto the outer circumferential surface of the holding drum 105. The electrostatically adsorbed paper S is sent to the print unit 109 by rotation of the holding drum 105.

The print unit 109 is fixed to the ink jet printer 100 such that ink discharge surfaces of the ink jet heads 1A to 1D are separated a distance from the outer circumferential surface of the holding drum 105. In an embodiment, the separation distance is 1 mm. With a configuration of being longer in the axial direction of the holding drum 105 (main scanning direction) and being shorter in a rotation direction (sub-scanning direction), each of the ink jet heads 1A to 1D are disposed at intervals in a circumferential direction of the holding drum 105. Detailed structure of the ink jet heads 1A to 1D is described below. An ink tank 113 is an ink container that stores a cyan ink. An ink supplying device 112 is disposed between the ink tank 113 and the ink jet head 1A. The ink supplying device 112 is provided with a pump and a pressure adjusting mechanism. The pump supplies the cyan ink in the ink tank 113, which is disposed below the ink jet head 1A in a gravity direction, to the inkjet head 1A. The inkjet head 1A discharges ink droplets in the gravity direction (downwards in the Y-axis). For this reason, there is a need for maintaining the ink jet head 1A under negative pressure with respect to atmospheric pressure such that the cyan ink does not leak from the ink jet head 1A. The pressure adjusting mechanism adjusts the pressure of the ink so as to be negative pressure with respect to the atmospheric pressure such that the ink supplied to the ink jet head 1A does not leak from a nozzle of the ink jet head 1A. Each of the ink jet heads 1B to 1D are provided with an ink tank and ink supplying device similar to the ink tank 113 and ink supplying device 112 (not shown).

In the print unit 109, each of the ink jet heads 1A to 1D print an image by discharging inks onto the paper S. The image to be printed is drawn in accordance with an image signal supplied to the ink jet printer 100 from an external device. The ink jet head 1A discharges the cyan ink and forms a cyan image. Similarly, the ink jet head 1B discharges a magenta ink, the ink jet head 1C discharges a yellow ink, the ink jet head 1D discharges a black ink, thereby printing images in each color. The ink jet heads 1A to 1D have the same structure excluding the colors of inks to be discharged.

The paper S on which printing is completed by the print unit 109 is transported to a static elimination device 110 and a separation claw 111. The static elimination device 110 is made such that a section thereof is in a U-shape, and is configured such that a tungsten wire is taut in a stainless steel housing having a length that is the same as the length in the axial direction of the holding drum 105. The static elimination device 110 is disposed such that an opening of the U-shape housing faces the outer circumferential surface of the holding drum 105. A high voltage generating circuit 117 generates a high voltage having a polarity opposite to that of a voltage applied to the charging roller 108. When an end of the paper S on which printing is completed is transported below the static elimination device 110, the high voltage generated by the high voltage generating circuit 117 is applied between the housing and the tungsten wire. The high voltage causes a corona discharge to occur from an opening side of the static elimination device 110 and static electricity is eliminated from the charged paper S. The separation claw 111 is provided such that a claw tip can move between a position at which the claw tip comes into contact with the outer circumferential surface of the holding drum 105 and a position at which the claw tip is separated apart from the outer circumferential surface. In general, the separation claw 111 is held at the position apart from the outer circumferential surface. In a case of separating the paper S from the holding drum 105, the tip of the separation claw 111 comes into contact with the outer circumferential surface of the holding drum 105 and separates the end of the paper S, from which static electricity is eliminated, from the insulating layer 105*a*. After the end of the paper S is separated from the outer circumferential surface, the separation claw 111 returns to the position apart from the outer circumferential surface.

The paper S separated from the holding drum 105 is sent to a pair of sending rollers 115*c*. The downstream transport path 104*b* is configured with the pair of sending rollers 115*c*, pairs of sending rollers 115*d* and 115*e*, and the paper guiding plate 116 that regulates the transport direction of the paper S. The paper S is output to the paper output tray 103 by the pairs of sending rollers 115*c*, 115*d*, and 115*e* along the dashed arrow in FIG. 1.

A configuration of the ink jet head 1A will be described in detail. As described above, the ink jet heads 1B to 1D have the same structure as that of the ink jet head 1A.

Figure 2:
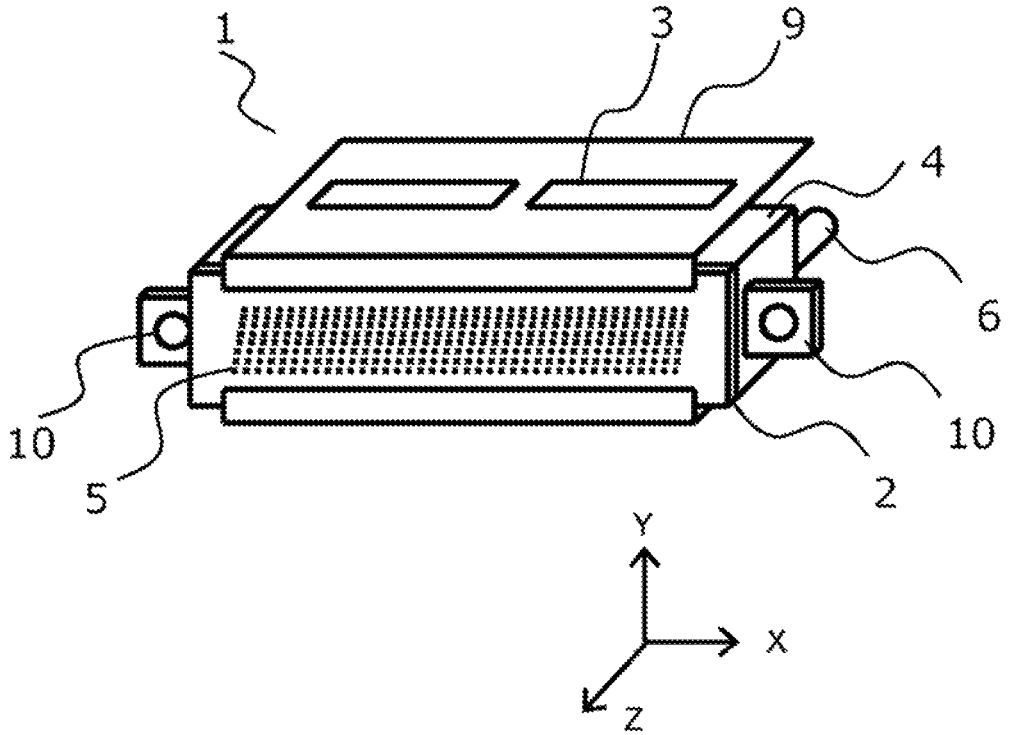
FIG. 2 is a perspective view illustrating an ink jet head of the first embodiment.

FIG. 2 is an exterior perspective view illustrating an ink jet head 1. The ink jet head 1 is configured with an ink supplying port 6, an ink supplying member 4, an actuator substrate 2, and a driver integrated circuit (IC) 3 (drive circuit 3). A fixing unit 10 is configured to fix the inkjet head 1 to the ink jet printer 100. A plurality of actuators 5 that generate pressure to discharge an ink is formed in the actuator substrate 2. The actuator substrate 2 is fixed to the ink supplying member 4 with an epoxy adhesive. The ink supplying port 6 is connected to the ink supplying device 112 and receives an ink at a predetermined supply pressure. The ink supplying port 6 is connected to the ink supplying member 4 and the ink is supplied from the ink supplying member 4 to each actuator 5 of the actuator substrate 2.

The driver IC 3 generates a control signal and a drive signal for driving each actuator 5. The driver IC 3 generates a control signal related to a timing at which an ink is discharged and selection of an actuator 5 to discharge in accordance with an image signal for printing, which is supplied from a device external to the ink jet printer 100. Furthermore, the driver IC 3 generates a voltage to be applied to a piezoelectric element 35 of the actuator 5, that is, a drive signal in accordance with the control signal. Details of the drive signal are described below. The driver IC 3 is disposed on a flexible substrate 9 (e.g., FPC: flexible printed circuit) and is connected to a wiring circuit of the FPC. Wiring of the actuator substrate 2 and the wiring circuit of the flexible substrate 9 are electrically connected to each other by an anisotropic conductive film.

Figure 3:
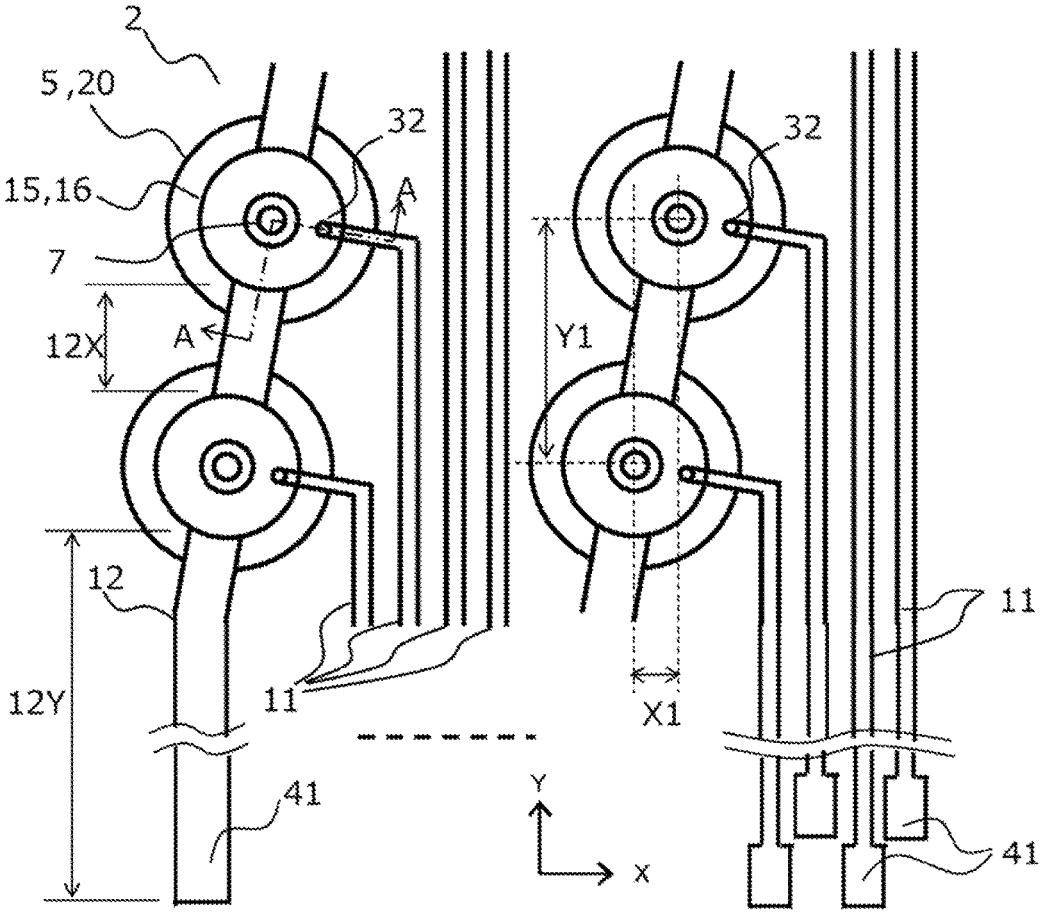
FIG. 3 is a plan view of the ink jet head of the first embodiment when seen from an ink discharging port side.
Figure 4:
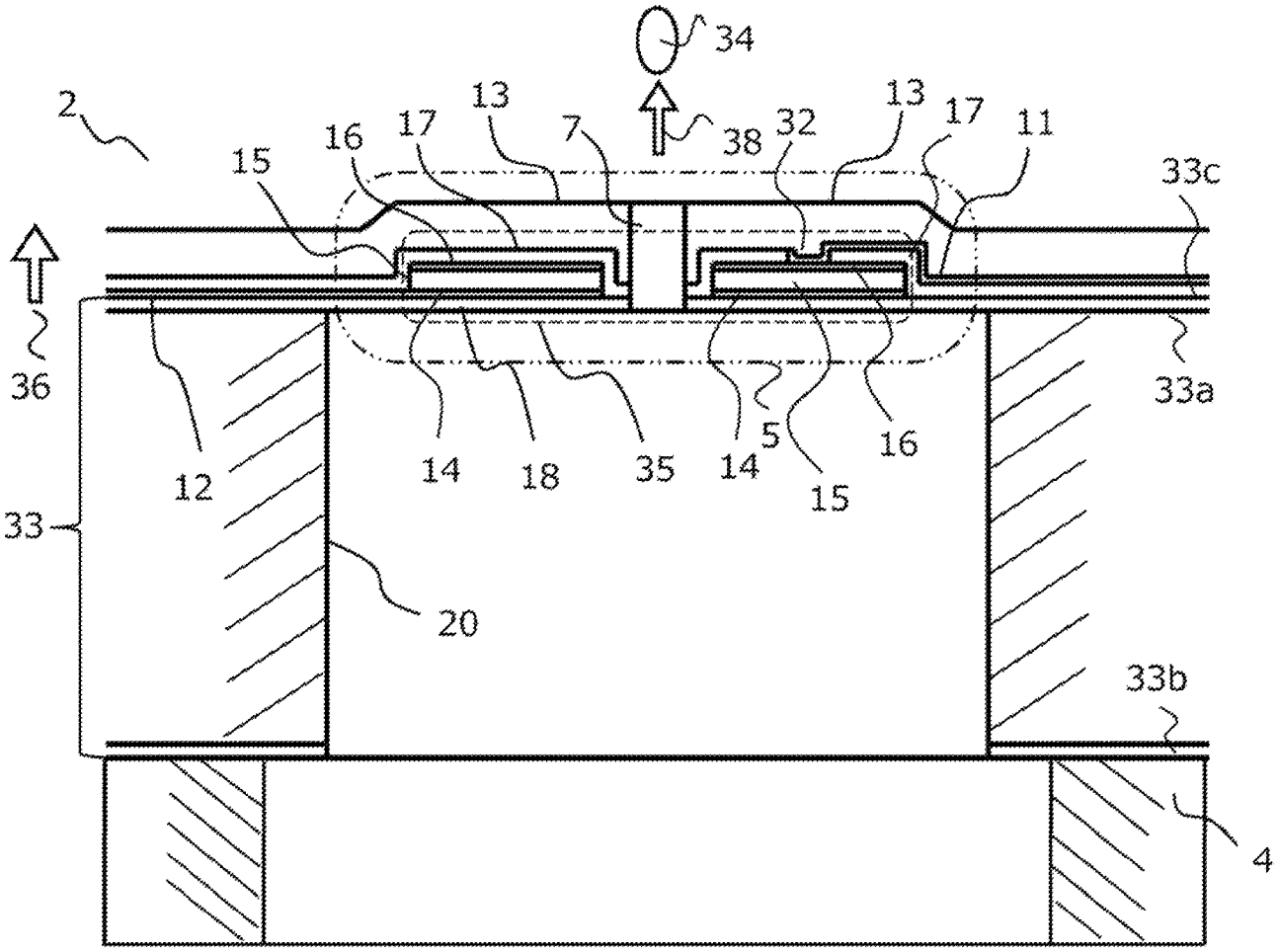
FIG. 4 is a sectional view of an ink jet head taken along A-A of FIG. 3.

A configuration of the actuator substrate 2 will be described with reference to FIGS. 3 and 4. FIG. 3 is an enlarged plan view of a part of the actuator substrate 2. The plan view illustrates the actuators 5, individual electrodes 11, common electrodes 12 that are seen from an ink discharge side (Z-axis side in FIG. 2). FIG. 4 is a sectional view taken along line A-A of the actuator substrate 2 illustrated in FIG. 3, and is a view seen from an A arrow direction.

The circular actuators 5 are disposed across two dimensions on the exterior surface of the actuator substrate 2 (FIG. 3). A nozzle 7 that discharges an ink is formed at the center of the actuator 5. Ink droplets are discharged from the nozzle 7 in a Z-axis direction (FIG. 2) by operation of the actuator 5. Each of the nozzles is disposed apart from each other at a distance X1 in an X-axis direction and at a distance Y1 in the Y-axis direction. In an embodiment, X1 is set to 21.2 μm, and Y1 is set to 250 μm. In an embodiment, the nozzles are disposed such that the printing density (dot per inch (DPI)) of the ink jet head 1 in the X-axis direction becomes 1,200. The printing density in the Y-axis direction is determined by the circumferential speed of the holding drum 105 and ink discharge time. In this embodiment, printing in the Y-axis direction is also performed at 1,200 DPI. On end portions of the individual electrode 11 and the common electrode 12, a terminal electrode 41 is formed. The wiring of the actuator substrate 2 and the wiring circuit of the flexible substrate 9 are electrically connected to each other by means of the ACF through the terminal electrode 41. The terminal electrode 41 is an input port to send a drive signal to the actuator 5.

As illustrated in FIG. 4, the ink, which is supplied from the ink supplying port 6 to the ink supplying member 4, is supplied to a pressure chamber 20 that is opened in the back surface of the actuator substrate 2. The actuator 5 changes the volume of the pressure chamber 20 according to a drive signal generated by the driver IC 3. Due to the change in the volume, the ink in the pressure chamber 20 is pressurized and is discharged from the nozzle 7 as an ink droplet 34 in an arrow 38 direction (Z-axis direction of FIG. 2). The actuator substrate 2 is configured with a substrate 33 and the actuators 5.

The substrate 33 (FIG. 4) is a single crystal silicon plate having a thickness of, for example, 400 μm. The substrate 33 includes a first surface 33*a* having the actuator 5 and a second surface 33*b* that opposes the first surface 33*a*. At a position corresponding to the actuator 5 of the substrate 33, a cylindrical opening is formed from the first surface 33*a* to the second surface 33*b*. The opening on a first surface 33*a* side is covered with the actuator 5, and the opening functions as the pressure chamber 20. The pressure chamber 20 on a second surface 33*b* side communicates with an ink supplying member. The pressure chamber 20 is a pressure generating chamber that generates pressure to discharge an ink from the nozzle 7 by operation of the actuator 5. In an embodiment, the opening is 200 μm in diameter and is 400 μm in length. The second surface 33*b* of the substrate 33 is adhered to the ink supplying member 4 with an epoxy resin.

As illustrated in FIG. 4, the actuator 5 is configured with a protective layer 18, the piezoelectric element 35, and a volume changeable plate 13 that changes the volume of the pressure chamber 20 and changes the pressure of the ink. The piezoelectric element 35 is configured with a lower electrode 14, a changeable plate 15 that stretches according to an electric signal, an upper electrode 16, and an insulating layer 17. The piezoelectric element 35 is disposed between the pressure chamber 20 and the volume changeable plate 13, and is fixed to the volume changeable plate 13. The stretching changeable plate 15 is configured as the piezoelectric body film 15 in this embodiment. The volume changeable plate 13 deforms due to stretching of the piezoelectric body film 15 and changes the pressure of the ink in the pressure chamber 20. The volume changeable plate 13 is configured as a diaphragm 13 in this embodiment. At the center of the actuator 5, the nozzle 7 that discharges the ink is formed. The nozzle 7 is a cylindrical hole (e.g., 20 μm in diameter), which penetrates the actuator 5, and communicates with the pressure chamber 20. The piezoelectric body film 15 is sandwiched between the lower electrode 14 and the upper electrode 16, and is polarized 36 in a direction orthogonal to both of the electrode surfaces. The piezoelectric element 35 surrounds the nozzle 7 and is formed in an approximately annular shape (FIG. 3). In the piezoelectric element 35, the piezoelectric body film 15 contracts in a surface direction when a voltage is applied between the lower electrode 14 and the upper electrode 16. Due to the contraction of the piezoelectric body film 15, the diaphragm 13 deforms and pressurizes the ink in the pressure chamber 20, causing the ink to be discharged from the nozzle 7. The configuration of the pressure chamber 20 is simplified since the nozzle 7 is provided in the actuator 5. The ink jet head 1 is easily manufactured since the pressure chamber 20 can be made by forming the opening in the substrate 33.

The protective layer 18 is integrated with the substrate 33 such that the pressure chamber 20 on the first surface 33*a* side is covered. The protective layer 18 can be an insulating silicon thermal oxide film ($SiO_2$).

The protective layer 18 is made through the next processes. The single crystal silicon substrate 33 is heated at a high temperature, and silicon thermal oxide films are made on both surfaces of the substrate 33. The silicon thermal oxide film and the single crystal silicon are dry-etched from the second surface 33*b* side, leaving the silicon thermal oxide film on the first surface 33*a* side, and a hole corresponding to the pressure chamber 20 is processed. The silicon thermal oxide film that remains on the first surface 33*a* side functions as the protective layer 18 that covers one surface of the pressure chamber 20. Since the protective layer 18 is made by processing the exterior surface of the single crystal silicon substrate 33, the first surface 33*a* of the substrate corresponds to a single crystal silicon boundary surface with the protective layer 18 (e.g., silicon thermal oxide film). The second surface 33*b* corresponds to the exterior surface of the silicon thermal oxide film made on the substrate 33.

The thickness of the protective layer 18 can be within a range of 0.1 μm to 1 μm. In this embodiment, the thickness of the protective layer is 0.5 μm. In a case where the protective layer 18 is too thick, operation of the actuator 5 is impeded. In a case where the protective layer 18 is too thin, there is a possibility that the silicon thermal oxide film is scraped too much during dry-etching and thus the protective layer 18 disappears. If the protective layer 18 is lost, the lower electrode 14 and the ink come into contact with each other and the lower electrode 14 corrodes. For this reason, there is a need for manufacturing the protective layer having a desired thickness.

The piezoelectric element 35 is formed on the exterior surface of the protective layer 18. The exterior surface of the protective layer 18 is a surface 33*c* that opposes the first surface 33*a* of the protective layer 18. As described above, the piezoelectric element 35 is configured such that thin films, including the lower electrode 14, the piezoelectric body film 15, and the upper electrode 16, are stacked on the exterior surface of the protective layer 18. Furthermore, the piezoelectric element 35 is formed in a donut shape (or annular shape) with the nozzle 7 at the center. The inner diameter of the donut shape is larger than the outer diameter of the nozzle 7, and the outer diameter of the donut shape is smaller than the inner diameter of the pressure chamber 20. In an embodiment, the inner diameter of the piezoelectric element 35 is 30 μm, and the outer diameter thereof is 140 μm. The donut shape of the lower electrode 14 and the upper electrode 16 is a shape excluding individual electrode 11 and common electrode 12 portions connected to each of the electrodes.

As illustrated in FIG. 3, the common electrode 12 is electrically connected to one electrode of the plurality of piezoelectric body films 15. In this embodiment, the lower electrode 14 of the four actuators 5 is connected as the common electrode 12. Each individual electrode 11 is electrically connected to the other electrode of the piezoelectric body film 15. The individual electrode 11 is connected to the upper electrode 16 through a contact hole 32 and functions to operate the selected piezoelectric body film 15. In FIG. 3, a plurality of sets are juxtaposed with the four actuators 5 as one set. In other wiring techniques, it is possible to connect the lower electrode 14 to the individual electrode 11 and to set the upper electrode 16 as the common electrode 12.

In an embodiment, the material of the lower electrode 14 and the upper electrode 16 is platinum (Pt). The thickness of the lower electrode 14 and the thickness of the upper electrode 16 are, for example, 0.1 μm, respectively. Platinum layers are made by the sputtering method, and are processed into the donut-shaped lower electrode 14 and upper electrode 16 so as to match the shape of the piezoelectric body film 15 by photo-etching. It is also possible to use other methods such as vacuum deposition and plating as film making methods. The thickness of the lower electrode 14 and the thickness of the upper electrode 16 can be 0.01 μm to 1 μm.

The piezoelectric body film 15 is made with a thin film that contains a piezoelectric material. When an electric field is applied to the piezoelectric body film 15 via the lower electrode 14 and the upper electrode 16, the piezoelectric element 35 contracts in a direction (in-plane direction) orthogonal to an electric field direction. The piezoelectric body film 15 functions as a changeable plate that stretches according to supplied power. Due to this contraction, the diaphragm 13 deforms in a thickness direction of the actuator 5 and changes the pressure of the ink in the pressure chamber 20.

In an embodiment, lead zirconate titanate (PZT) is used as the material of the piezoelectric body film 15. It is also possible to use other materials such as KNN ($(KNa)NbO_3$: potassium sodium niobate), PTO ($PbTiO_3$: lead titanate), PMNT ($Pb(Mg_{1/3}Nb_{2/3})O_3$—$PbTiO_3$), PZNT ($Pb(Zn_{1/3}Nb_{2/3})O_3$—$PbTiO_3$), ZnO, and AlN.

The piezoelectric body film 15 is formed by the radio frequency (RF) magnetron sputtering method. The thickness thereof is approximately 2 μm, for example. It is also possible to use other piezoelectric body film manufacturing methods such as chemical vapor deposition (CVD), the sol-gel method, the aerosol deposition method (AD method), and the hydrothermal synthesis method. The thickness of the piezoelectric body film is determined by accounting for a piezoelectric property and a dielectric breakdown voltage.

The insulating layer 17 formed of an insulating inorganic material is provided on the protective layer 18, the lower electrode 14, the piezoelectric body film 15, and the upper electrode 16. The insulating layer 17 is disposed between the lower electrode 14 and the individual electrode 11 to maintain insulation of the lower electrode 14 and the individual electrode 11 in an outer peripheral portion of the piezoelectric body film 15. An opening (e.g., having a diameter of 10 μm) is formed in the insulating layer 17 for electrically connecting the upper electrode 16 and the individual electrode 11 to each other. The opening of the insulating layer 17 is provided such that the upper electrode 16 is exposed. The upper electrode 16 and the individual electrode 11 are electrically connected to each other through the opening of the insulating layer 17. The opening, which allows this electrical connection, is referred to as the contact hole 32.

In an embodiment, the insulating layer 17 is a silicon dioxide film ($SiO_2$). The silicon dioxide film is formed by tetraethoxysilane-chemical vapor deposition (TEOS-CVD method).

The individual electrode 11 and the common electrode 12, which are for applying a voltage to the piezoelectric body film 15, extend to peripheral portions of the actuator substrate 2. The individual electrode 11 and the common electrode 12, which extend to the peripheral portions, are connected to the terminal electrode 41. The terminal electrode 41 is electrically connected to the driver IC 3 on the FPC 9 as illustrated in FIG. 2.

In an embodiment, the material of the individual electrode 11 and the common electrode 12 is gold (Au). In an embodiment, the thickness of the individual electrode 11 and the thickness of the common electrode 12 are 0.5 μm, respectively. Gold layers for the individual electrode 11 and the common electrode 12 are formed by the sputtering method. After making the insulating layer 17 having the contact hole 32, a gold film is formed and the individual electrode 11 is made by photo-etching. As illustrated in FIG. 3, the individual electrode 11 is connected to the platinum upper electrode 16 through the contact hole 32 and forms a wiring pattern and the terminal electrode 41 that extend to the peripheral portions of the actuator substrate 2. The common electrode 12 connects the lower electrodes of the two adjacent actuators 5 (12X) and forms the wiring pattern and the terminal electrode 41 (12Y), which extend to the peripheral portions of the actuator substrate 2. In this embodiment, common electrodes 12X and 12Y are two-layer films that contain platinum and gold with the connection between the lower electrode 14 and the common electrode 12 being taken into account.

The diaphragm 13 that contains an insulating inorganic material is provided on the protective layer 18, the lower electrode 14, the piezoelectric body film 15, the upper electrode 16, the insulating layer 17, the individual electrode 11, and the common electrode 12. In an embodiment, the thickness of the diaphragm 13 is 4 μm. A thickness of the diaphragm 13 can be between 2 to 10 μm, for example between 4 to 6 μm. When the piezoelectric body film 15 stretches, the diaphragm 13 that contains an insulating inorganic material warps. A plate that warps is called as a diaphragm. The diaphragm 13 is a volume changeable plate that functions to change the pressure of the ink in the pressure chamber due to the deformation.

The flexural rigidity of the diaphragm 13 is higher than the flexural rigidity of the protective layer 18 or the flexural rigidity of other film. The flexural rigidity is a product of the Young's modulus and the second moment of area and indicates the difficulty of bending deformation of a beam member. The diaphragm 13 contains a material with a higher Young's modulus than those of the protective layer 18, the piezoelectric body film 15, and the insulating layer 17. Furthermore, the thickness of the diaphragm 13 is larger than thicknesses of the protective layer 18, the piezoelectric body film 15, and the insulating layer 17. The Young's modulus of PZT, which is a piezoelectric material, is approximately 60 GPa. The Young's modulus of silicon dioxide is approximately 70 GPa. The Young's modulus of silicon nitride is approximately 300 GPa. Therefore, the flexural rigidity of the diaphragm 13 is higher than the flexural rigidity of the piezoelectric body film 15, the flexural rigidity of the protective layer 18, and the flexural rigidity of the insulating layer 17.

The material of the diaphragm 13 is silicon nitride ($Si_3N_4$). A film is formed of silicon nitride by plasma enhanced chemical vapor deposition (PECVD method) and is made into the diaphragm 13. If a residual stress occurs in the diaphragm 13 in a compression direction when making the diaphragm 13, there is a possibility that contraction deformation of the piezoelectric body film 15 is impeded. In a case where the piezoelectric body film 15 is unlikely to deform, the driving efficiency of the ink jet head 1 declines. Silicon nitride can decrease the residual stress compared to silicon dioxide. The efficiency of the actuator 5 can be improved by using silicon nitride with a lower residual stress. In addition, as described above, the Young's modulus of silicon nitride is approximately 300 GPa, the Young's modulus of silicon dioxide is approximately 70 GPa, and it is possible to have a silicon nitride thickness smaller than a silicon dioxide thickness to obtain the same flexural rigidity. From such a perspective, the diaphragm 13 is made with silicon nitride. Instead of silicon nitride for the diaphragm 13, $Al_2O_3$ (aluminum oxide: the Young's modulus 360 GPa), AlN (aluminum nitride: the Young's modulus 320 GPa), and SiC (silicon carbide: the Young's modulus 440 GPa) can be used as well.

As illustrated in FIG. 4, the nozzle 7 that discharges an ink penetrates the diaphragm 13 and is provided in the actuator 5. Since the actuator 5, in which the diaphragm 13, the piezoelectric element 35, and the nozzle 7 are integrally configured, forms one surface of the pressure chamber 20, the structure of the ink jet head including the ink supplying member 4 is simple and is easy to manufacture. In addition, when the ink is continuously discharged, the ink is attached and remains near the nozzle 7 on the exterior surface of the diaphragm 13, in some cases. To remove this residual ink, the exterior surface of the diaphragm 13 is scraped by a rubber blade. This scraping operation is referred to as wiping. A surface of the diaphragm 13 on the ink discharge side requires scratch resistance to withstand wiping, which is repeatedly performed. Since the silicon nitride diaphragm 13 having a predetermined thickness is excellent in terms of scratch resistance, it is possible to maintain the predetermined thickness of the diaphragm 13 even if the diaphragm 13 is wiped.

Figure 5A:
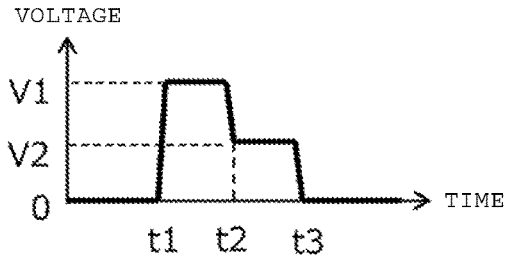
FIGS. 5A to 5D are explanatory diagrams of operation of the ink jet head of the first embodiment.

The driver IC 3 applies a voltage between the common electrode 12 connected to the lower electrode 14 of the plurality of actuators 5 and the individual electrode 11 connected to the upper electrode 16 of each actuator 5. The common electrode 12 is grounded and a voltage is applied to the individual electrode 11. A voltage to operate the actuator 5 has a drive waveform illustrated in FIG. 5A. In the drive waveform for discharging one ink droplet, a voltage V1 is applied between times t1 and t2, a voltage V2 is applied between times t2 and t3, and 0 V is applied at the time t3. Until the time t1, the ink jet head 1 is in a standby state at 0 V.

In this embodiment, V1 and V2 are described as positive voltages. It is also possible to operate with V1 and V2 as negative voltages. The ink jet head 1 of this embodiment operates with the unipolar power supply of V1 and V2. Since the power supplies of both of positive and negative polarities are not necessary, it is possible to drive the ink jet head 1 with more affordable power.

A driving method for the ink jet head 1 of this embodiment will be described in detail with reference to FIGS. 5A to 5D.

The actuator 5 is provided with the piezoelectric element 35, in which the lower electrode 14, the piezoelectric body film 15, and the upper electrode 16 are stacked, between the diaphragm 13 and the pressure chamber 20. When a drive signal is applied between the lower electrode 14 and the upper electrode 16, a large electric field is generated at the piezoelectric body film 15 having a thickness of 2 μm, for example. Due to the effect of the electric field, the piezoelectric body film 15 expands in a thickness direction and contracts in a direction orthogonal to the thickness direction, that is, the in-plane direction of the actuator 5. When the piezoelectric body film 15 contracts in the in-plane direction, the actuator 5, in which the diaphragm 13 and the piezoelectric element 35 are combined, deforms in a direction where the volume of the pressure chamber 20 increases. When the voltage becomes 0 V, the piezoelectric element 35 returns to the original state and the pressure chamber 20 returns to the original volume. This ink discharging method according to a change in the volume is referred to as pulling-out.

Figure 5B:
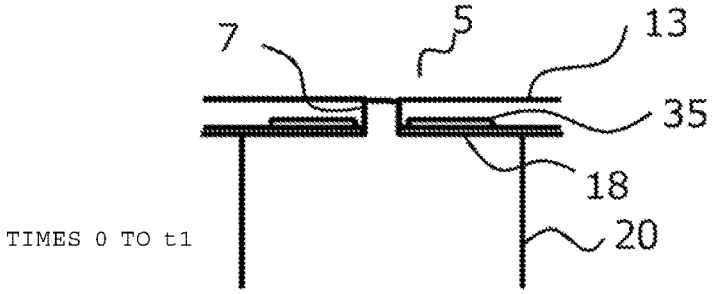

FIG. 5B illustrates a standby state before discharging an ink when the voltage is 0 V from times 0 to t1. In the standby state, the ink is supplied by the ink supplying device 112 from the ink tank 113 to the ink supplying port 6. Furthermore, the ink is injected from the ink supplying port 6 into the ink supplying member 4 and the pressure chamber 20 is filled from the back surface of the actuator substrate 2. The ink supplying device 112 adjusts ink supply pressure such that the pressure of the ink in the inkjet head 1 becomes, for example, −1 kPa. By the pressure of the ink being set to −1 kPa, compared to the atmospheric pressure, a meniscus is formed within the nozzle 7 without the ink leaking from the nozzle 7. In the standby state, the driver IC 3 does not output a drive voltage and a voltage between the lower electrode 14 and the upper electrode 16 is 0 V.

Figure 5C:
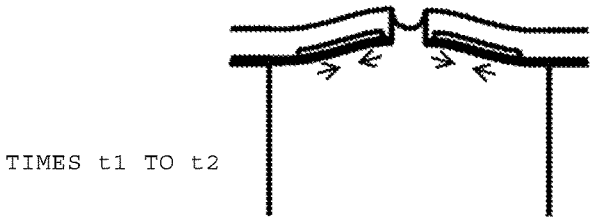
Figure 5D:
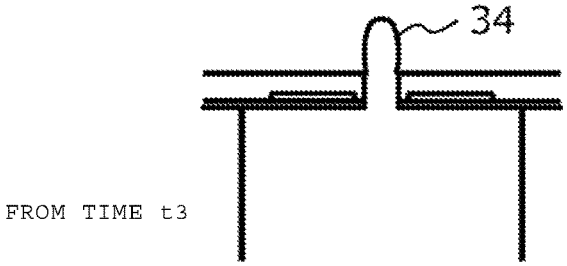
Figure 6A:
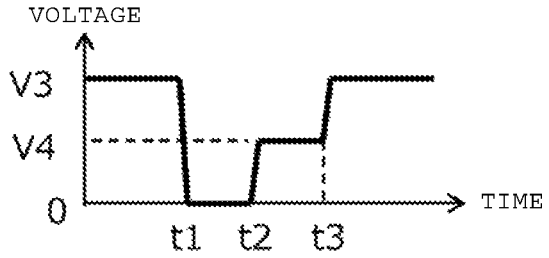
FIGS. 6A to 6D are explanatory diagrams of operation of the ink jet head of a comparative example.
Figure 6B:
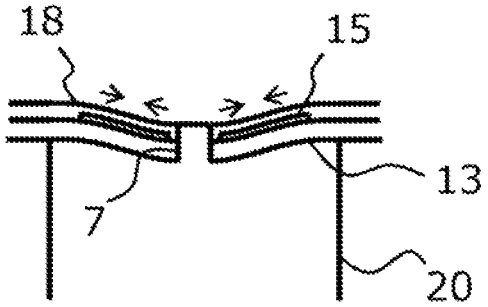
Figure 6C:
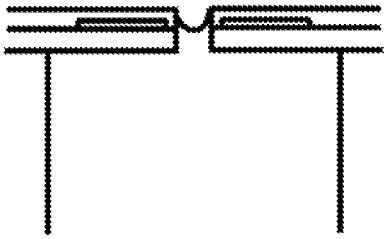
Figure 6D:
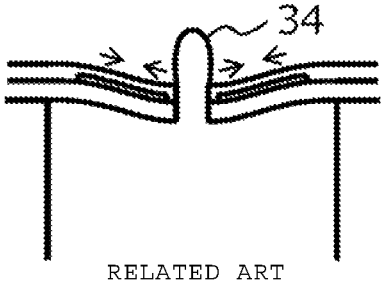

Since the ink is discharged toward the paper, the driver IC 3 outputs the voltage V1 at the time t1 in FIG. 5C. The voltage V1 is applied between the lower electrode 14 and the upper electrode 16 through the common electrode 12 and the individual electrode 11, and an electric field is generated at the piezoelectric body film 15. When the electric field acts on the piezoelectric body film 15, the piezoelectric body film 15 expands in the thickness direction and contracts in the direction orthogonal to the thickness. In this embodiment, the voltage V1 is set to 24V. The value of the voltage V1 is set to a predetermined voltage due to the configurations of the piezoelectric element 35, the diaphragm 13, and the pressure chamber 20.

When the piezoelectric body film 15 contracts in the direction orthogonal to the thickness (in-plane direction) at the time t1, the diaphragm 13 on a pressure chamber 20 side contracts. As illustrated in FIG. 3, the piezoelectric body film 15 is in an annular shape that is surrounded by an outer circumferential circle and an inner circumferential circle surrounding the nozzle 7. By the contraction of the diaphragm 13 on the pressure chamber 20 side, the actuator 5, including the piezoelectric body film 15 and the diaphragm 13, convexly deforms toward the upper side in FIG. 5C due to the annular shape. When deforming convexly, the actuator 5 deforms in a direction where the ink is discharged from the nozzle 7 at the center such that the volume of the pressure chamber 20 increases. Due to the increase in the volume of the pressure chamber 20, the pressure of the ink in the pressure chamber 20 becomes far more negative pressure than −1 kPa. The pressure becomes negative pressure of approximately −300 kPa and the ink meniscus formed in the nozzle 7 starts to retreat to a pressure chamber side. Then, the ink from the ink supplying member 4 flows into the pressure chamber 20 and the pressure in the pressure chamber 20, which is negative pressure, starts to rise.

As the voltage V1 increases, the deformation amount of the actuator 5 increases. As the deformation amount of the actuator 5 increases, a pressure change in the pressure chamber 20 increases. However, due to a large pressure change, there is a possibility that the ink meniscus greatly retreats, air from the nozzle 7 becomes bubbles, and the bubbles get into the pressure chamber 20. In addition, in a case where the voltage V1 is high, there is a possibility that the piezoelectric body film 15 causes dielectric breakdown. In a case where the voltage V1 is low, the deformation amount of the actuator 5 is small and a change in the pressure of the ink in the pressure chamber 20 is small. For this reason, an ink cannot be discharged from the nozzle 7. Thus, an appropriate range of an electric field generated at a piezoelectric body is approximately 10 to 20 MV/m.

The pressure of the ink in the pressure chamber 20 falls at the time t1 and the meniscus in the nozzle 7 retreats. The ink meniscus stops to retreat at the time t2 and the pressure of the ink in the pressure chamber 20 starts to change from negative pressure to positive pressure. The vibration of the ink is a natural frequency determined by physical properties including the structure of the pressure chamber 20 and the actuator 5 and the density of the ink. One half of the vibration period of the ink is length of time from the time t1 to the time t2. The driver IC 3 causes the voltage to decline from V1 to V2 at the time t2. In an embodiment, the voltage V2 is one half of the voltage V1. The deformation of the actuator 5 is approximately half at a voltage of V2 compared to V1, and the increased volume of the pressure chamber 20 decreases. Due to the change, which is a decrease in the volume of the pressure chamber 20 at the time t2, the ink in the pressure chamber 20 is further pressurized and is discharged from the nozzle 7 as the ink droplet 34. When the ink starts to be discharged from the nozzle 7, the pressure of the ink in the pressure chamber 20 starts to decline.

A ratio of the voltages V1 to V2 and the length of time from the times t1 to t2 are determined according to an ink vibration attenuation rate. For example, when an ink has a viscosity of approximately 10 mPa·s, the voltage V2 is approximately one half of the voltage V1. By setting the voltage V1 to 24 V and setting the voltage V2 to 12 V, reduction in cost of power supply circuits can be achieved. In a case where a high-viscosity ink is discharged, a difference between the voltages V1 and V2 is set to a large value.

The pressure of the ink pressurized at the time t2 changes to negative pressure at the time t3 due to the vibration of the ink. The driver IC 3 causes the drive voltage to decline from V2 to 0 V at the time t3. When the drive voltage is 0 V, the actuator 5 returns to the standby state from approximately the half deformation and the volume of the pressure chamber 20 decreases again. When the volume of the pressure chamber 20 decreases at the time t3, the ink in the pressure chamber 20, which is under negative pressure, is pressurized toward positive pressure and the pressure almost returns to a pressure at the time of standby. A change in the voltage from the voltage V2 to 0 V at the time t3 quickly decreases the residual vibration of the ink in the pressure chamber 20 and the pressure of the ink in the pressure chamber 20 returns to −1 kPa, which is the pressure at the time of standby. One ink droplet 34 is discharged from the nozzle 7 according to the drive waveform from the times t1 to t3. It is possible to increase a printing speed by quickly returning to the negative pressure at the time of standby since time from discharging the ink droplet to discharging the next ink droplet can be shortened.

In pulling-out, the pressure of an ink is caused to decline, pressure vibration is caused before discharging the ink, and the ink is further pressurized at a time point when the pressure of the ink is raised to discharge the ink. For this reason, it is possible to discharge the ink from the nozzle 7 at high pressure. In addition, since the ink is discharged once the ink meniscus is retreated to the pressure chamber side, the ink is accelerated in the nozzle 7. It is possible to raise rectilinear movement of the ink droplet 34 to be discharged by accelerating the ink in the nozzle 7. Since the accuracy of a landing position on the paper S rises when the rectilinear movement of the ink droplet is high, the resolution of a drawing improves.

In addition, when operating the ink jet head 1 by the pulling-out method, there is no need for applying an electric field to the piezoelectric body film 15 in a standby state. An ink can be discharged by generating a predetermined electric field at the piezoelectric body film 15 only when discharging the ink. Since there is no need for continuously applying the electric field to the piezoelectric body film 15 in a standby state, the deterioration of the piezoelectric body film 15 is restricted, and prolonging the life of the ink jet head 1 can be achieved.

In an ink jet head using an actuator in which a thick bulky piezoelectric body is stacked on a diaphragm, instead of a thin-film piezoelectric body, the bulky piezoelectric body is driven within an electric field area that does not cause polarization reversal of the piezoelectric body. The electric field area that causes polarization reversal is called as a coercive electric field. In the ink jet head that drives the bulky piezoelectric body within an area of the coercive electric field, the piezoelectric body expands in a direction orthogonal to the polarization in a case where a polarization direction of the piezoelectric body and the orientation of the electric field are the same. The piezoelectric body contracts in the direction orthogonal to the polarization in a case where the polarization direction of the piezoelectric body and the orientation of the electric field are opposite to each other. For this reason, it is possible to expand or contract the pressure chamber by controlling the orientation of the electric field to be exerted to the piezoelectric body.

In the ink jet head 1 of the embodiment, which has the piezoelectric body film 15, the piezoelectric body film 15 is operated in an electric field that exceeds the coercive electric field. Since the thickness of the piezoelectric body film 15 of the actuator 5 is as thin as several μm, an electric field that exceeds the coercive electric field at a low voltage is generated at the piezoelectric body film 15. When the piezoelectric body film 15 is driven by the electric field that exceeds the coercive electric field, a distortion direction of the piezoelectric body is the same regardless of the orientation of the electric field with respect to the polarization direction. That is, a direction of displacement of the actuator is constant regardless of the orientation of the electric field.

For reference, a configuration of an ink jet head of the related art and a drive voltage waveform will be described with reference to FIGS. 6A to 6D. An actuator is configured with the diaphragm 13 that forms a part of the wall surface of the pressure chamber 20, the piezoelectric body film 15 having a thickness of several μm or less, a pair of electrodes that sandwich the piezoelectric body film 15, and the protective layer 18 that covers a piezoelectric body and the electrodes. That is, the piezoelectric body film 15 is provided on the surface of the diaphragm 13 on the ink discharge side. The diaphragm is formed such that rigidity thereof is higher than the rigidity of the protective layer.

In the ink jet head of the related art, the diaphragm that is provided so as to be integrated with the piezoelectric body contracts in a surface direction due to voltage application and as a result, the diaphragm is displaced in a direction where the volume of the pressure chamber decreases. As described above, when the piezoelectric body thin film is driven by the electric field that exceeds the coercive electric field, the distortion direction of the piezoelectric body is the same regardless of the orientation of the electric field with respect to the polarization direction. For this reason, in performing pulling-out operation, there is a need for continuously exerting a voltage in advance to the piezoelectric body at the time of standby before discharging an ink, setting the voltage to 0 V when discharging the ink, and again exerting a voltage to the piezoelectric body after discharging the ink. In other words, there is a need to continuously generate an electric field at the piezoelectric body at all times in a standby state.

When an electric field is continuously generated at the piezoelectric body thin film for a long period of time, there is a possibility that the piezoelectric body thin film deteriorates and eventually dielectric breakdown is caused. When the piezoelectric body thin film causes the dielectric breakdown, ink discharging operation becomes impossible. In the ink jet head of the related art, the length of time in a standby state where the ink is not discharged is at least ten times longer than the length of time for which the piezoelectric body is operated and the ink is discharged. Compared to the configuration of the related art in which there is a need for continuously applying the voltage to the piezoelectric body in the standby state, it is possible to achieve prolonged life of the ink jet head without a need for applying a voltage in the standby state in the configuration of the embodiment.

As in the above description, the ink jet printer 100 includes an ink tank which stores an ink, a substrate in which a pressure chamber that communicates with a nozzle discharging the ink is formed, a volume changeable plate which changes the volume of the pressure chamber and changes a pressure of the ink, and a changeable plate which is disposed between the volume changeable plate and the pressure chamber. The changeable plate stretches according to an electric signal supplied from the outside, which contracts the changeable plate in an in-plane direction by applying the electric signal to the changeable plate, enlarges the volume of the pressure chamber at the time of standby, and causes the volume of the pressure chamber to return to the volume at the time of standby by stopping the application of the electric signal. The inkjet printer includes a pressure adjusting mechanism that communicates with the ink tank and the ink jet head and maintains the pressure of the ink in the pressure chamber at the time of standby at negative pressure with respect to the atmospheric pressure. The ink jet printer includes a paper transporting mechanism that transports paper, on which printing is performed with the ink discharged from the inkjet head.

There are characteristics of a method for driving the ink jet head in this embodiment. This method is a method for driving the ink jet head including a substrate, in which a pressure chamber that communicates with a nozzle discharging an ink is formed, a volume changeable plate that changes the volume of the pressure chamber and changes a pressure of the ink, and a changeable plate that is disposed between the volume changeable plate and the pressure chamber and stretches according to an electric signal supplied from the outside. In this driving method, the changeable plate is contracted in an in-plane direction by applying the electric signal to the changeable plate. Consequently, the volume of the pressure chamber is enlarged. This is a method for driving the inkjet head in which the volume of the pressure chamber is caused to return to the original state by stopping the application of the electric signal.

After being changed from 0 V to a first voltage, the electric signal is changed to a second voltage which has the same polarity as that of the first voltage and is lower than the first voltage. A driving method in which the voltage is caused to return to 0 V after being changed to the second voltage is more preferable.

The ink jet head of the embodiment includes a substrate in which a pressure chamber is formed, a volume changeable plate that changes the volume of the pressure chamber and changes a pressure of an ink, and a changeable plate that is disposed between the volume changeable plate and the pressure chamber. The changeable plate stretches according to an electric signal supplied from the outside. The ink is discharged by applying the electric signal to the changeable plate, contracting the changeable plate in the in-plane direction to enlarge the volume of the pressure chamber, and causing the volume of the pressure chamber to return to the original state by stopping the application of the electric signal. The ink jet head that applies a voltage to the changeable plate when discharging the ink without applying the voltage to the changeable plate at the time of standby is realized. According to this configuration, there is no need to continuously apply a voltage to the changeable plate at the time of standby and the deterioration of the changeable plate can be restricted. The life of the ink jet head can be prolonged by restricting the deterioration of the changeable plate.

In the ink jet head of the embodiment, the flexural rigidity of the volume changeable plate is higher than the flexural rigidity of the protective layer. Specifically, the volume changeable plate contains silicon nitride. Since silicon nitride has a low residual stress and has high flexural rigidity, it is possible to raise the driving efficiency of the ink jet head. Furthermore, the nozzle that discharges the ink is provided so as to penetrate the volume changeable plate and the protective layer. It is possible to easily manufacture the ink jet head by integrally forming the nozzle, the volume changeable plate, and the protective layer.

Second Embodiment

Figure 7:
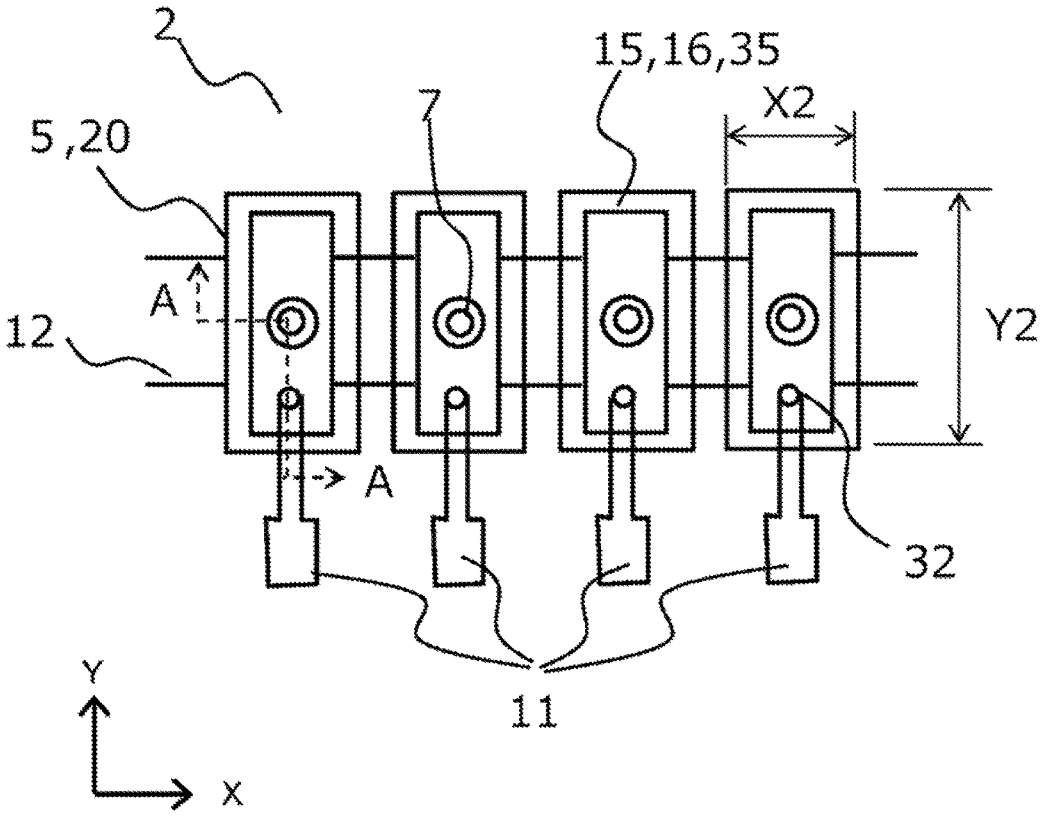
FIG. 7 is a plan view of an ink jet head of a second embodiment when seen from an ink discharging port side.

The ink jet head 1 of a second embodiment will be described with reference to FIG. 7. FIG. 7 is a view of the ink jet head 1 seen from an ink discharge surface side. The actuator 5 is a rectangle when seen from the ink discharge surface side. In an embodiment, a lateral dimension X2 of the pressure chamber 20 is 120 μm and a longitudinal dimension Y2 is 240 μm. In an embodiment, a piezoelectric element is laterally 100 μm and is longitudinally 220 μm. In the middle of the piezoelectric element 35, the nozzle 7 having a diameter of 20 μm (for example) is formed. The structure of the section is the same as the structure illustrated in FIG. 4. In addition, the structure of the ink jet printer 100 is also the same as the structure of FIG. 1.

The ink jet head of the second embodiment also has effects that are obtained with the ink jet head of the first embodiment. Furthermore, lead-out wiring of the individual electrodes 11 and the common electrode 12 becomes easy by disposing the rectangular actuators 5 in one line in the X-axis direction. A manufacturing yield improves by the individual electrodes 11 and the common electrode 12 being made easily.

Third Embodiment

The ink jet head 1 of a third embodiment will be described with reference to FIGS. 8A, 8B and 9. The structure of the ink jet printer 100 is the same as the structure of FIG. 1.

Figure 8A:
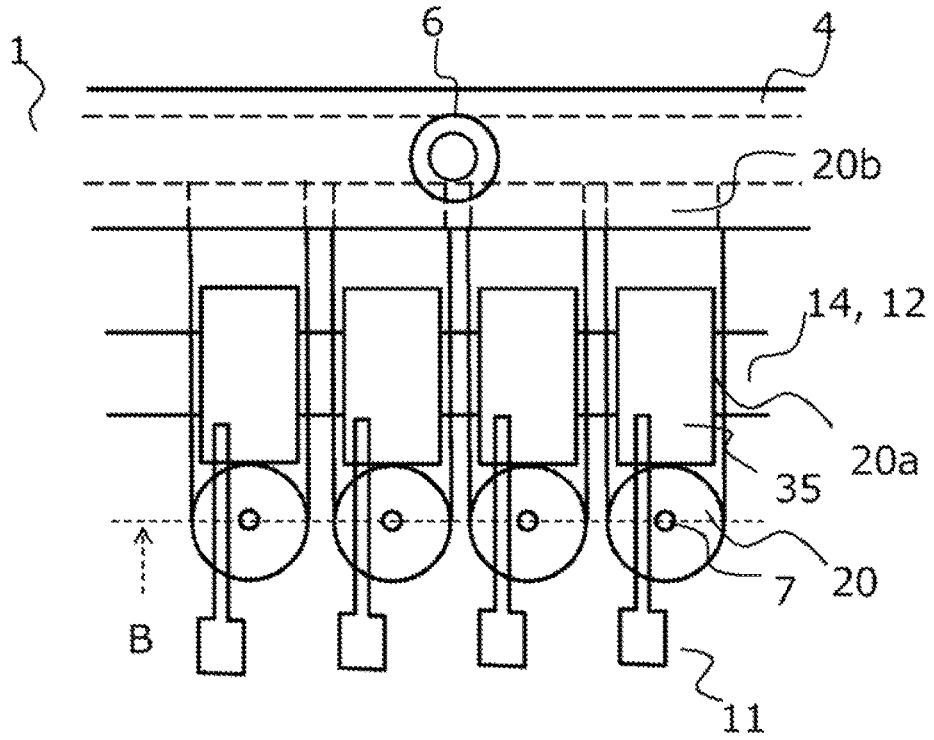
FIGS. 8A and 8B are a sectional view and a plan view of an ink jet head of a third embodiment.
Figure 8B:
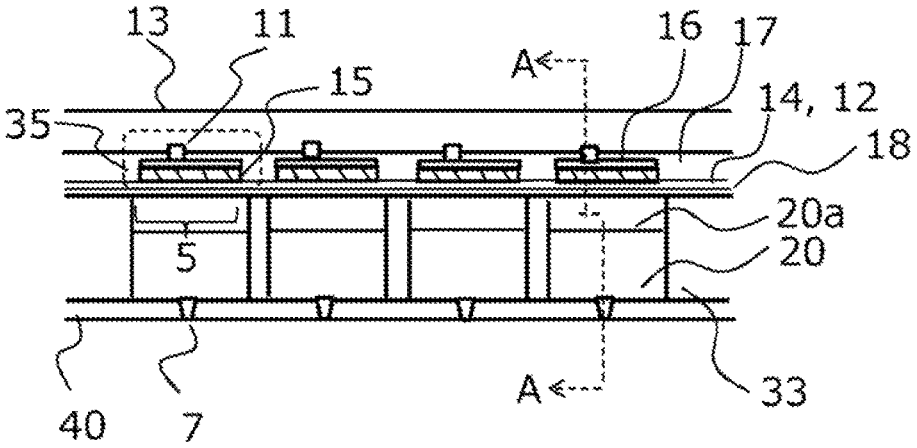
Figure 9:
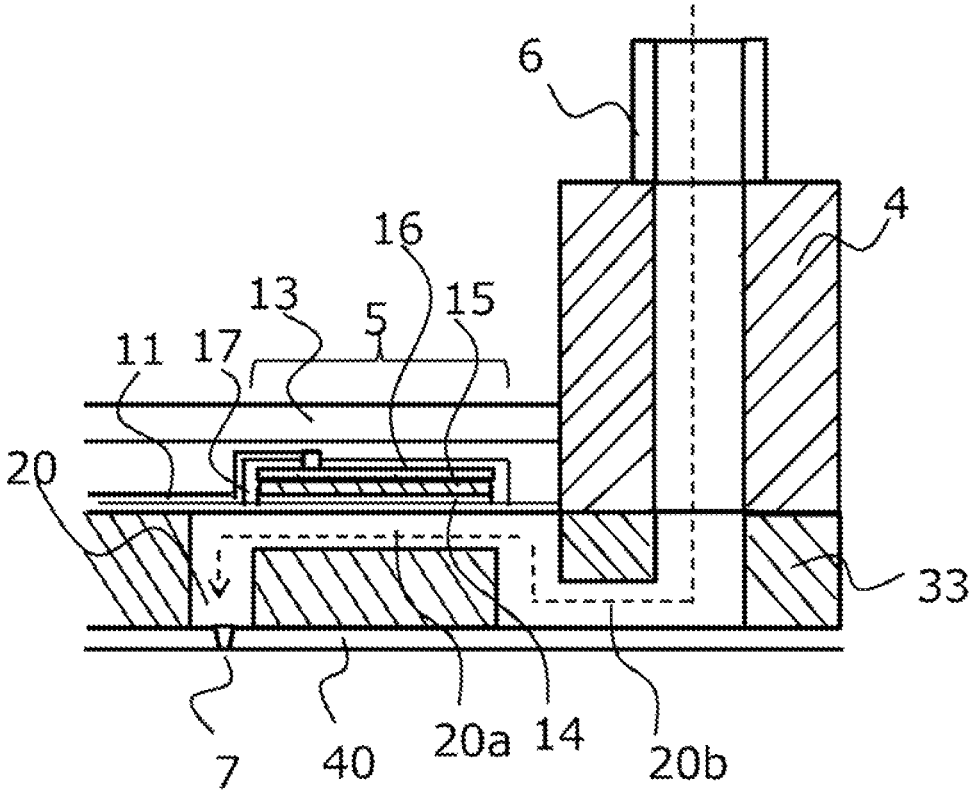
FIG. 9 is a sectional view of the ink jet head of the third embodiment.

FIG. 8A is a plan view illustrating a plurality of pressure chambers 20 of the ink jet head 1. In a central portion of the cylindrical pressure chamber 20, the nozzle 7 is disposed. The rectangular piezoelectric element 35 is disposed at a position shifted from the upper portion of the pressure chamber 20. The common electrode 12 and the individual electrodes 11 are connected to each piezoelectric element 35. FIG. 8B is a sectional view of FIG. 8A when seen in a B-direction. As illustrated in FIG. 8B, the ink jet head 1 has the substrate 33 in which the pressure chambers 20 are formed, the actuators 5 that form one surface of the pressure chambers 20, and a nozzle plate 40 that forms the other surface of the pressure chambers 20. That is, the actuator 5 and the nozzle 7 are configured so as to be separated from each other. FIG. 9 illustrates A-A section of FIG. 8B. The pressure chamber 20 communicates with a pressure chamber 20*a* below the actuator 5. The pressure chamber 20*a* communicates with the ink supplying member 4 through an ink passage 20*b* formed in the substrate 33. The actuator 5 is provided with the piezoelectric element 35, in which the lower electrode 14, the piezoelectric body film 15, and the upper electrode 16 are stacked, on a pressure chamber 20*a* side of the diaphragm 13. The diaphragm 13 of the actuator 5 contains silicon nitride having high flexural rigidity.

Due to the deformation of the actuator 5, pressure generated in the ink causes the ink to be discharged from the nozzle 7 through the pressure chamber 20*a* and the pressure chamber 20. When a voltage is applied to the rectangular piezoelectric body film 15, the piezoelectric body film 15 contracts in the in-plane direction. When the piezoelectric body film 15 contracts, the diaphragm 13 above the piezoelectric body film 15 deforms such that the volume of the pressure chamber 20*a* enlarges. When the voltage application is stopped, the piezoelectric body film 15 returns to the original shape and the pressure chamber 20*a* also returns to the original volume. The piezoelectric body film 15 is operated according to the drive waveform illustrated in FIG. 5A. Pulling-out printing can be performed due to a change in the pressure of the ink, which is caused by the change in the volume of the pressure chamber 20*a*. The ink flows along an arrow from the ink supplying port 6 and is discharged from the nozzle 7.

The life of the inkjet head of the third embodiment can be prolonged by restricting the deterioration of the changeable plate (e.g., piezoelectric body film) in the ink jet head. In addition, it is possible to raise the driving efficiency of the ink jet head since silicon nitride, used for the volume changeable plate (e.g., diaphragm), has a low residual stress and has high flexural rigidity. The configuration of the third embodiment is different from the configurations of the first and second embodiments in that the nozzle is provided in the nozzle plate. In the third embodiment, after each of the nozzle plate, the substrate, and the actuator are separately made, the nozzle plate, the substrate, and the actuator are adhered to each other to make the ink jet head. It is possible to make each of the nozzle plate, the substrate, and the actuator with high accuracy since the nozzle plate, the substrate, and the actuator are separately made.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An ink jet head, comprising:

a substrate having a pressure chamber formed therein, the pressure chamber being in communication with a nozzle through which ink is to be discharged;

a first plate that is deformable to change a volume of the pressure chamber; and a second plate, between the first plate and the pressure chamber, that stretches in response to an electric signal applied thereto, wherein when the electric signal at a standby voltage is applied, the pressure chamber is in a standby state, when the electric signal at a driving voltage is applied, the second plate contracts in an in-plane direction to cause the first plate to deform and thereby the pressure chamber to be in an enlarged state, the absolute value of the standby voltage being less than the absolute value of the driving voltage, and when the electric signal is changed from the driving voltage to the standby voltage after an ink droplet is discharged, the second plate returns to an original shape thereof to cause the first plate to return to an original shape thereof and thereby the pressure chamber to return to the standby state.

2. The ink jet head according to claim 1, wherein the standby voltage is 0 V.

3. The ink jet head according to claim 2, further comprising:

a protective layer between the second plate and the pressure chamber, wherein a flexural rigidity of the first plate is higher than a flexural rigidity of the protective layer.

4. The ink jet head according to claim 3, wherein the electric signal is a unipolar voltage having a positive polarity or a negative polarity.

5. The ink jet head according to claim 4, wherein the electric signal, after changing from the standby voltage to a first voltage, changes to a second voltage, which has the same polarity as the polarity of the first voltage and is lower than the first voltage, and returns to the standby voltage after changing to the second voltage.

6. The ink jet head according to claim 3, wherein the electric signal, after changing from the standby voltage to a first voltage, changes to a second voltage, which has the same polarity as the polarity of the first voltage and is lower than the first voltage, and returns to the standby voltage after changing to the second voltage.

7. The ink jet head according to claim 2, wherein the electric signal is a unipolar voltage having a positive polarity or a negative polarity.

8. The ink jet head according to claim 3, wherein the second plate is made of a piezoelectric material.

9. The ink jet head according to claim 8, wherein the second plate has a thickness of approximately 2 μm.

10. The ink jet head according to claim 9, wherein the first plate comprises silicon nitride, aluminum oxide, aluminum nitride, or silicon carbide.

11. An ink jet head, comprising:

a substrate having a pressure chamber formed therein, the pressure chamber being in communication with a nozzle through which ink is to be discharged;

a first plate that is deformable to change a volume of the pressure chamber;

a second plate, between the first plate and the pressure chamber, that stretches in response to an electric signal applied thereto, the pressure chamber being in a standby state when the electric signal at a standby voltage is applied; and a drive circuit that generates the electric signal which, when applied at a driving voltage to the second plate, controls the second plate to contract in an in-plane direction to cause the first plate to deform and thereby the pressure chamber to be in an enlarged state, the absolute value of the standby voltage being less than the absolute value of the driving voltage, and when applied at the standby voltage after an ink droplet is discharged, controls the second plate to return to an original shape thereof to cause the first plate to return to an original shape thereof and thereby the pressure chamber to return to the standby state.

12. The ink jet head according to claim 11, wherein the standby voltage is 0V.

13. The ink jet head according to claim 12, further comprising:

a protective layer disposed between the second plate and the pressure chamber, wherein flexural rigidity of the first plate is higher than flexural rigidity of the protective layer.

14. The ink jet head according to claim 13, wherein the electric signal is a unipolar voltage having a positive polarity or a negative polarity.

15. The ink jet head according to claim 14, wherein the electric signal, after changing from the standby to a first voltage, changes to a second voltage, which has the same polarity as the polarity of the first voltage and is lower than the first voltage, and returns to the standby after changing to the second voltage.

16. The ink jet head according to claim 14, wherein the electric signal, after changing from the standby to a first voltage, changes to a second voltage, which has the same polarity as the polarity of the first voltage and is lower than the first voltage, and returns to the standby after changing to the second voltage.

17. The ink jet head according to claim 12, wherein the electric signal is a unipolar voltage having a positive polarity or a negative polarity.

18. The ink jet head according to claim 13, wherein the second plate is made of a piezoelectric material.

19. The ink jet head according to claim 18, wherein the second plate has a thickness of approximately 2 μm.

20. The ink jet head according to claim 14, wherein the first plate comprises silicon nitride, aluminum oxide, aluminum nitride, or silicon carbide.

21. A method of driving an ink jet head including a substrate having a pressure chamber formed therein, a nozzle in communicate with the pressure chamber, a first plate that is deformable to change the volume of the pressure chamber, and an actuator having a second plate disposed between the first plate and the pressure chamber, the method comprising:

changing an electric signal applied to the actuator from 0V to a first voltage to control the second plate to contract in an in-plane direction to cause the first plate to deform and thereby the volume of the pressure chamber to be enlarged;

changing the electric signal applied to the actuator from the first voltage to a second voltage; and changing the electric signal applied to the actuator from the second voltage to 0V to control the second plate to return to an original shape thereof to cause the first plate to return to an original shape thereof and thereby the volume of the pressure chamber to return to an original volume thereof.

22. The method of claim 21, wherein the second voltage has the same polarity as the first voltage and is lower than the first voltage.

* * * * *